US008479327B2

(12) United States Patent
McKenney

(10) Patent No.: US 8,479,327 B2
(45) Date of Patent: Jul. 9, 2013

(54) LIFTING AND SUPPORT DEVICE

(75) Inventor: Michael McKenney, Yarmouth, ME (US)

(73) Assignee: Standaid Corporation, Inc., Yarmouth, ME (US)

( * ) Notice: Subject to any disclaimer, the term of this patent is extended or adjusted under 35 U.S.C. 154(b) by 0 days.

(21) Appl. No.: 13/409,363

(22) Filed: Mar. 1, 2012

(65) Prior Publication Data

US 2012/0151674 A1 Jun. 21, 2012

Related U.S. Application Data

(63) Continuation-in-part of application No. PCT/US2010/047462, filed on Sep. 1, 2010.

(60) Provisional application No. 61/238,834, filed on Sep. 1, 2009.

(51) Int. Cl.
*A61G 7/14* (2006.01)
*A61G 7/08* (2006.01)

(52) U.S. Cl.
USPC ..... 5/86.1; 5/81.1 R

(58) Field of Classification Search
USPC ..... 5/86.1, 87.1, 89.1, 83.1, 81.1 R
See application file for complete search history.

(56) References Cited

U.S. PATENT DOCUMENTS

| | | | | | |
|---|---|---|---|---|---|
| 2,792,052 | A * | 5/1957 | Johannesen | 297/5 |
| 3,277,502 | A * | 10/1966 | Wauthier | 5/87.1 |
| 4,157,593 | A * | 6/1979 | Kristensson | 5/87.1 |
| 4,435,863 | A * | 3/1984 | Lerich | 5/87.1 |
| 4,510,633 | A * | 4/1985 | Thorne | 5/87.1 |
| 4,656,679 | A * | 4/1987 | James | 5/87.1 |
| 4,703,523 | A * | 11/1987 | James | 5/83.1 |
| 4,918,771 | A * | 4/1990 | James | 5/87.1 |
| 5,022,106 | A * | 6/1991 | Richards | 5/86.1 |
| 5,189,741 | A * | 3/1993 | Beardmore | 5/86.1 |
| 5,357,640 | A * | 10/1994 | McKenney et al. | 5/81.1 R |
| 5,369,821 | A * | 12/1994 | Richards et al. | 5/86.1 |
| 5,412,820 | A * | 5/1995 | Richards | 5/86.1 |
| 6,568,002 | B1 * | 5/2003 | Liljedahl | 5/86.1 |
| 2012/0151674 | A1 * | 6/2012 | McKenney | 5/86.1 |

FOREIGN PATENT DOCUMENTS

| | | |
|---|---|---|
| JP | 200265766 | 3/2002 |
| JP | 4193927 | 12/2008 |

* cited by examiner

*Primary Examiner* — Robert G Santos
(74) *Attorney, Agent, or Firm* — Patricia M. Mathers

(57) ABSTRACT

The invention is a support device for lifting and transporting a patient or other type of load. The support device has a frame mounted on a support base equipped with wheels and a brake. Long handles are attached to the frame, to provide a significant mechanical advantage to an operator. Lifting the handles tilts the frame on the support base and brings it down close to the load to be lifted. A lifting support, such as a seat or a sling, is secured around the load and the lifting support coupled to the frame. The operator moves the lifting handles back to a home position, thereby lifting the load. The lifting handles and wheels allow the operator to guide the support device to a desired location, to lower a patient to a chair or a bed or to move a load to a new location.

6 Claims, 6 Drawing Sheets

LIFTING AND SUPPORT DEVICE

BACKGROUND INFORMATION

1. Field of the Invention

The invention relates to a device for lifting a heavy load and moving it from one level to another. More particularly, the invention relates to a device for lifting a patient from the floor, a chair, or a bed, for example, and/or moving a patient between a sitting and a standing position.

2. Description of the Prior Art

Prior art devices are described in detail in U.S. Pat. No. 5,357,640, the disclosure of which is incorporated herein in its entirety, by reference. There are many known devices that are used by a person to transfer a patient from one sitting position to another sitting position. Many of them require a lot of body strength and may cause strain or injury to the person operating the device. Oftentimes a patient would simply like to stand up. Conventional transfer devices that are designed to bring a patient to a standing position require an electrical power source, such as a battery, which results in a cumbersome and heavy device.

What is needed is a device for moving a patient safely and easily, without the need for an external power source, other than the assistance provided by another person. What is further needed is such a device for transferring a patient from a bed to a chair, for example, or from a seated position to a standing position.

BRIEF SUMMARY OF THE INVENTION

The invention is a support device for lifting a load and moving it from one level to another. In the embodiments described herein, the device is used to move a patient, either between a seated and a standing position or from one location, such as a chair, to a second location, such as a bed, or to lift a patient from a floor. It is understood, however, that the device may be used to lift other types of loads and the description relating to lifting a patient is not intended to be limiting, and that the term "lifting seat" is a stand-in for other types of lifting support means, such as a sling, a box, a platform, etc.

The device according to the invention has a frame from which some type of lifting support means, such as a seat, is suspended. When used to lift a patient, the lifting seat may be coupled to the frame at three points, such that it encircles the rump of the patient and extends forward between the legs of the patient, thereby providing a secure lifting support for the patient's torso. The frame has an operator side and a load side, also frequently referred to hereinafter with reference to lifting a patient as the "patient side." Extending from the frame on the operator side are two long handles, which are used by an assisting person, i.e., an operator, to tilt the frame, so as to lift or lower the patient as needed. The handles are long enough to provide a significant mechanical advantage, so that the operator is easily capable of lifting the weight of the patient without undue strain, even if the patient is quite heavy, and even if the operator has relatively little lifting strength.

The frame is assembled on a platform that is equipped with wheels or casters and a brake system for locking the platform against inadvertent rolling. Once the patient is ensconced in the lifting seat, the device may be rolled to another location. For example, one can use the support device to lift a patient from a chair in one room, transport the patient to a bedroom, and lower the patient onto the bed.

The support device according to the invention may also include a chest support, which serves to provide some support for a patient who wishes to be held in an upright position.

The support device according to the invention may be equipped with an extended frame from which the lifting support means, such as a sling or box, is suspended, for lifting heavy objects, such as large dogs or other animals.

The support device requires no electrical, hydraulic, pneumatic, or other external power source, other than the lifting force provided by the operator.

BRIEF DESCRIPTION OF THE DRAWINGS

The present invention is described with reference to the accompanying drawings. The drawings are not necessarily drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art. Like reference designation numbers are used to identify features that are functionally similar, although they may not be identical in construction.

Figure 1:
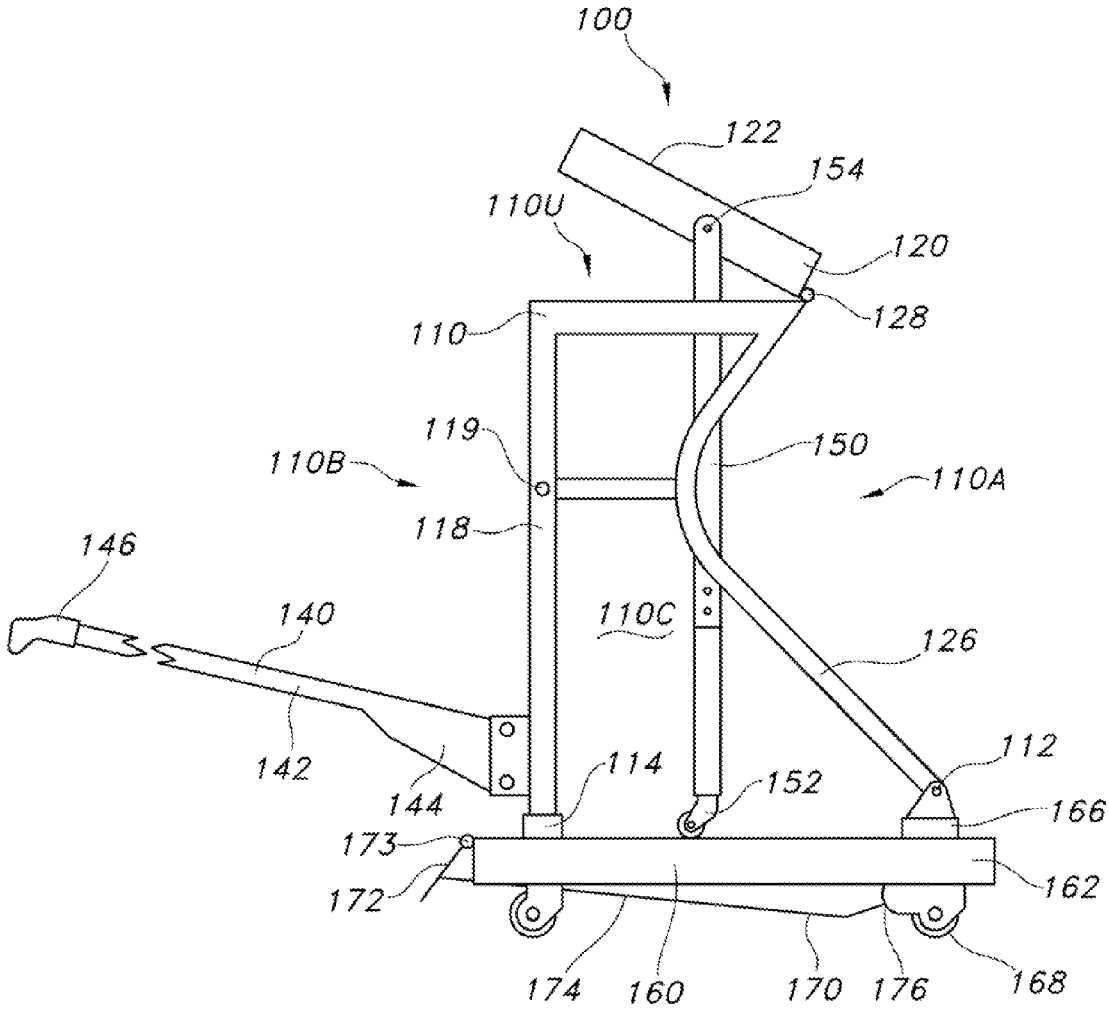
FIG. 1 is a side elevation view of the support device according to the invention.

FIG. 1 illustrates a first embodiment of a support device 100 for moving a patient between a sitting and a standing position, or for lifting a patient from a floor. For purposes of description, the sides of the support device 100 shall be referred to hereinafter as a patient side 110A, an operator side 110B, and lateral sides 110C. The support device 100 comprises a frame 110, a chest support 120, a lifting seat 130 (shown in FIGS. 3 and 4), a support base 160 with brake assembly 170, and lifting handles 140.

The frame 110 is mounted on the support base 160 and defines a four-sided frustum-shaped space, open on the patient side 110A for accommodating the patient. The lateral sides 110C are symmetrical in construction. In this first embodiment, the frame 110 has two patient-side or load-side legs 126 that extend forward of the chest support 120, to allow the lower portion of a patient's body to move into the frame without interference from the chest support and to provide some protection against falling sideways. This particular construction of the two load-side legs 126 is a suggestion only, and is not limiting. In other words, these legs 126 may be straight, rather than curved, may extend more or less at an angle relative to the vertical, or may be vertical. The load-side legs 126 are attached at their lower ends to the brackets 166 on the support base 160 by means of a pivot pin 112 about which the legs are rotatable. Two operator-side legs 118 form the operator side of the frame 110 and, preferably, have a non-slip base 114 at the lower ends.

The chest support 120 includes a pad 122 that is pivotably mounted on the front side of the upper portion 110U of the frame 110 by means of a hinge device 128, which allows the chest support 120 to tilt upward or lie flat on the upper portion 110U of the frame 110. FIG. 1 illustrates the chest support 120 in a raised position that is used to aid the patient to maintain an upright position. Two height-adjustable supports 150 are coupled to the chest support 120. The lower end of the height-adjustable support 150 is fitted with a caster roller 152 and the upper end 154 is coupled to a lifting point on the chest support 120. The chest support 120 is raised or lowered, depending on whether the patient is to be brought into or transferred from a standing position or a sitting position by adjusting the height of the supports 150.

Two lifting handles 140, each one fixedly attached to a respective one of the operator-side legs 118, are provided relatively low on the operator side 110B of the frame 110. The lifting handles 140 include two rigid bars 142. Each bar 142 is fixedly attached to the respective operator-side leg 118. A brace 144 and/or a crossbar 119 between the bars 142 may be provided as needed to reinforce the strength and rigidity of the lifting handles 140. Grips 146 are provided at the ends of the lifting handles 140, to facilitate grabbing and holding the lifting handles 140. These lifting handles 140 are sufficiently long to provide the desired mechanical advantage to an operator of the support device 100. By lifting up on the lifting handles 140, the operator is able to pivot the frame 110 about the pivot means 112, so as to tilt it toward the patient and bring the level of the lifting seat 130 down to a level that corresponds to the height of a chair seat or a bed.

Figure 6:
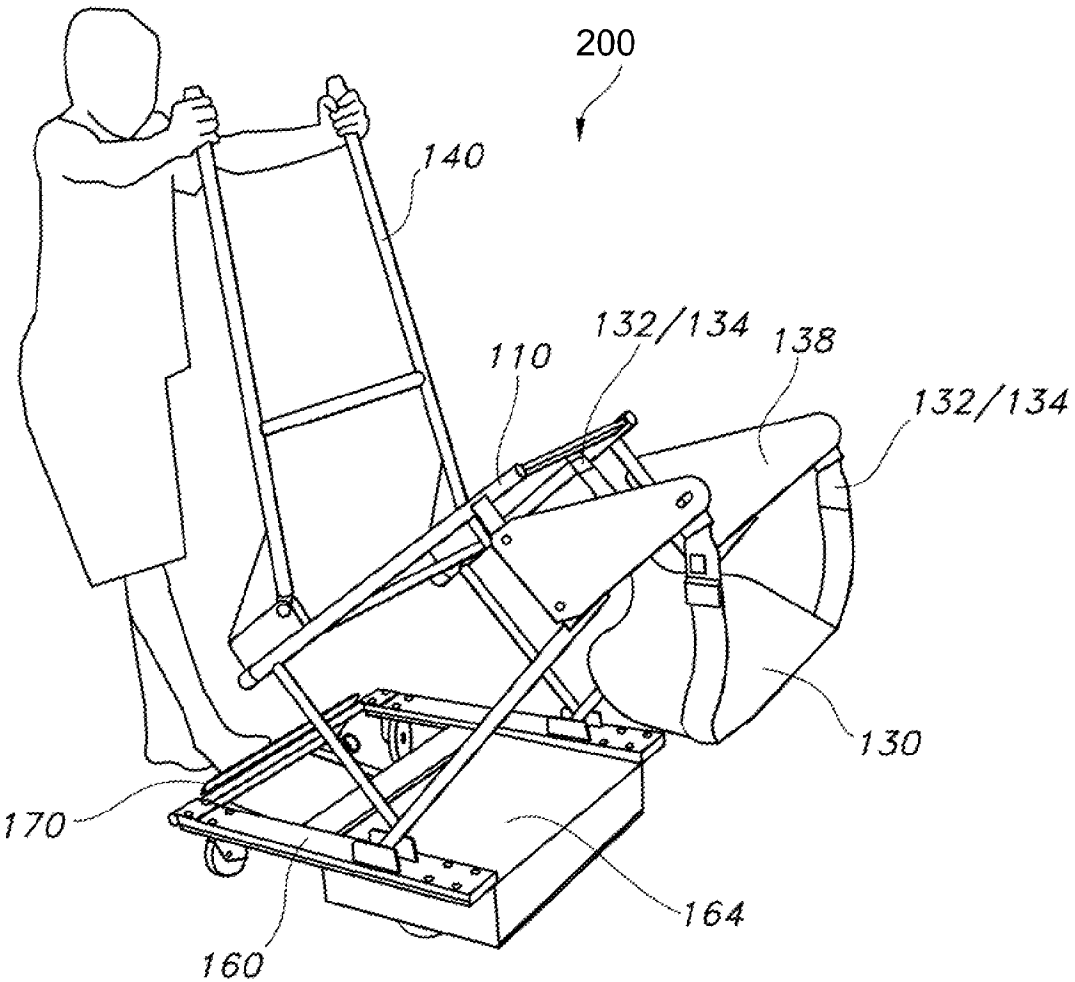
FIG. 6 illustrates a second embodiment of the support device according to the invention.

It is also possible to tilt the lifting handles 140 far enough forward to bring the lifting seat 130 down to the level of the floor. This enables the support device 100 to be used to lift patients who have fallen to the floor. FIG. 6 shows the lifting seat 130 brought to a level relatively close to the floor. It is clear, that by moving the lifting handles 140 farther forward, the lifting seat 130 can be brought down to the level of the floor. The person on the floor is moved to a seated position, the lifting seat 130 secured about the patient and the patient leaned forward onto the chest support. The lifting handles are then moved to the home position, thereby raising the patient to a standing or a seated position within the support device 100.

Figure 2:
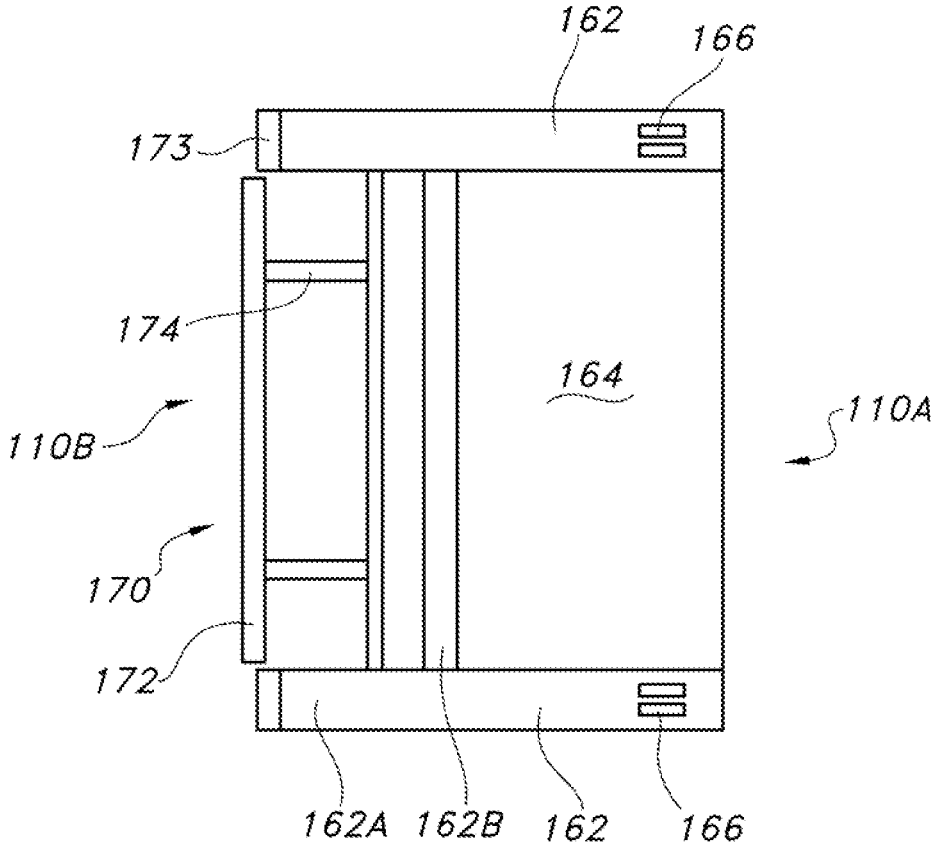
FIG. 2 is a top plan view of the support base.

FIG. 2 shows the support base 160, without the frame 110. The support base 160 has a base frame 162 that includes side frame elements 162A, a cross bar 162B, and a patient-support area 164. The frame 162 is mounted on four wheels 168 in swivel mounts. Brackets 166 are mounted on the base frame 162 to support a pivot means 112 for the frame 110, described below. The brake assembly 170 is mounted on the operator side 110B of the support base 160. A brake pedal 172 is mounted with hinges 173 to the support base 160 and extends across the operator side of the base. The brake pedal 172 is coupled to a brake frame 174, which includes a friction brake means 176 at each wheel 168 on the patient side 100A. An attachment means 138 for the lifting seat 130 is not shown in FIG. 1, in order to better illustrate the adjustment system for the chest support 120. See FIG. 4 for the attachment means 138.

Figure 3:
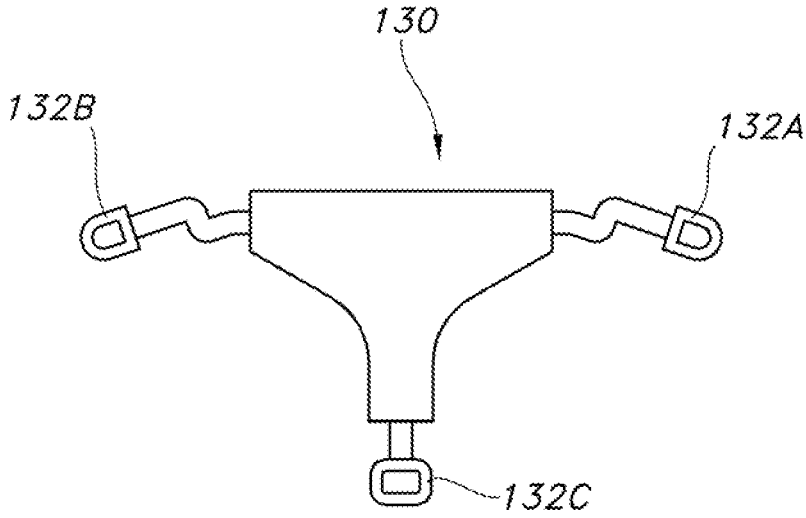
FIG. 3 is a plan view of a detachable seat.
Figure 4:
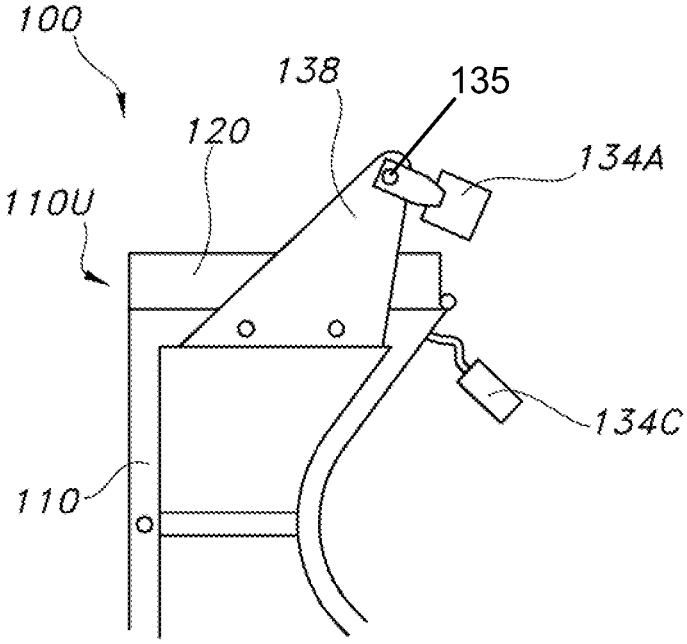
FIG. 4 shows the seat attachment means on the support frame.

FIG. 3 shows the lifting seat 130 with a three-point attachment system 132 that includes two side couplers 132A, 132B, and one lower coupler 132C. FIG. 4 shows the seat attachment means 138 assembled on the support frame 110. The lifting seat 130 is fitted around the patient so that the lower coupler 132C extends between the patient's legs, from the back to the front. The side couplers 132A, 132B are attached to mating couplers 134A, 134B that are provided on the attachment means 138 that is assembled on the upper portion 110U of the frame 110 and the lower coupler 132C is attached to a mating coupler 134C on the underside of the upper portion 110U. Preferably, the mating couplers 134A, 134B are attached to the attachment means 138 by a pivot means 135, so that the lifting seat 130 is able to swing outward when the frame 110 is manipulated to place the patient into a chair. The couplers 132A, 132B, and 132C may be conventional couplers, such as are used for seat belts in automobiles and airplanes. Other suitable couplers may also be used, of course. FIG. 4 is only a partial illustration of the support device 100, showing the chest support 120 in its lowered position. The position of the chest support 120 does not change the attachment arrangement of the seat couplers. When a patient who is capable of standing is being transported with the support device 100, he or she can lean over the lowered chest support 120 and grab onto the frame 110.

Figure 5:
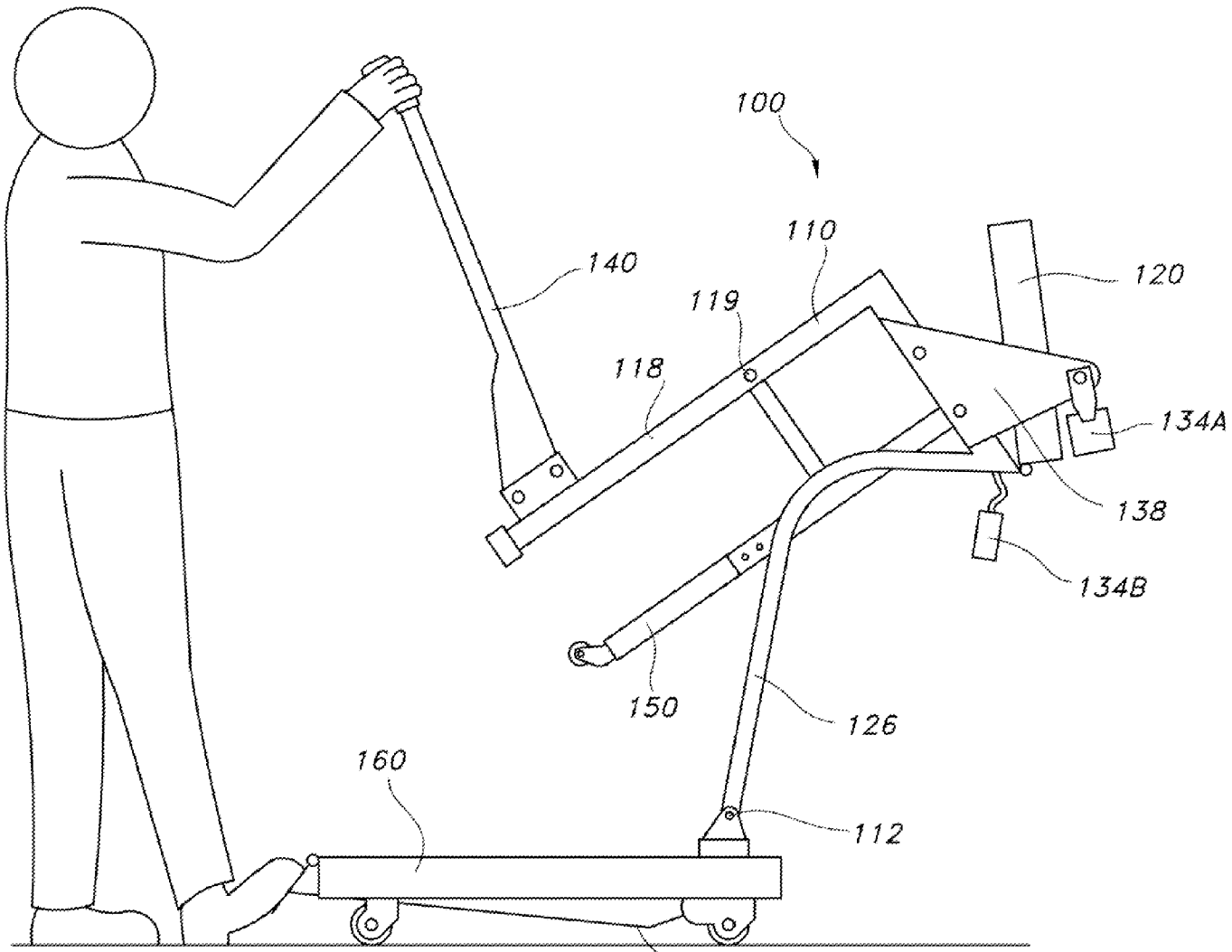
FIG. 5 is a perspective view of the support device, showing the device tilted to a position to accommodate a seated patient.

FIG. 5 is a side view of the support device 100, showing an operator (shown only schematically) tilting the device to a position that is appropriate for receiving a patient who is seated or lowering a standing patient to a chair. The operator is standing on the operator side of the frame, with his foot on the brake pedal 172 to prevent the support base 160 from moving and is tilting the frame 110 into a position to bring the mating couplers 134 close to the level of a seated patient. Assuming that the lifting seat 130 has been placed under a patient, who is sitting on a chair or a bed, the lifting-seat couplers 132 may now be coupled with the mating couplers 134. The patient may now be lifted from the chair or bed. By moving the lifting handles 140 back to the resting position, the patient is moved into the patient-side of the frame 110. FIG. 5 is a side view, but it is understood, that the operator is using both hands to lift the two lifting handles 140.

The patient may place his or her feet on the support base 160 and lean forward to rest his or her chest against the chest support 120 or simply remain suspended on the lifting seat 130. The patient may now be wheeled to any location. Travel motion may make a patient, particularly a standing patient, feel insecure, so it is recommended to provide some means for the patient to grab on to. In this embodiment, a padded crossbar 119 extends between the two operator-side legs 118. The patient will typically lean forward over the chest support 120 when being transported and, in this position is able to hold onto the padded bar 119 for added security. The crossbar 119 is indicated with a circle, showing the approximate location of the crossbar 119 on the frame 110. It is, of course, also feasible to provide handles for the patient to grab on to, on other parts of the frame that are readily accessible to the patient.

FIG. 6 illustrates a second embodiment of a support device 200 according to the invention, one that is constructed to support a patient in a lifting seat 130. The support device 200 comprises the frame 110 assembled on the support base 160, the lifting handles 140, the lifting seat 130 with the three-point attachment system 132 and the attachment means 138. all as described above. Not all patients have the ability to stand and this embodiment is a simplification of the first embodiment, in that the chest support has been eliminated, because it is not needed for patients who cannot stand. The lifting seat 130 is coupled to the mating couplers 134 of the frame 110 and the support device 200 operated as previously described. Once the patient is suspended in the lifting seat 130, the lifting handles 140 are brought back toward a comfortable position for the operator, and the patient is wheeled to a new location, all the while suspended in the lifting seat 130.

Figure 7:
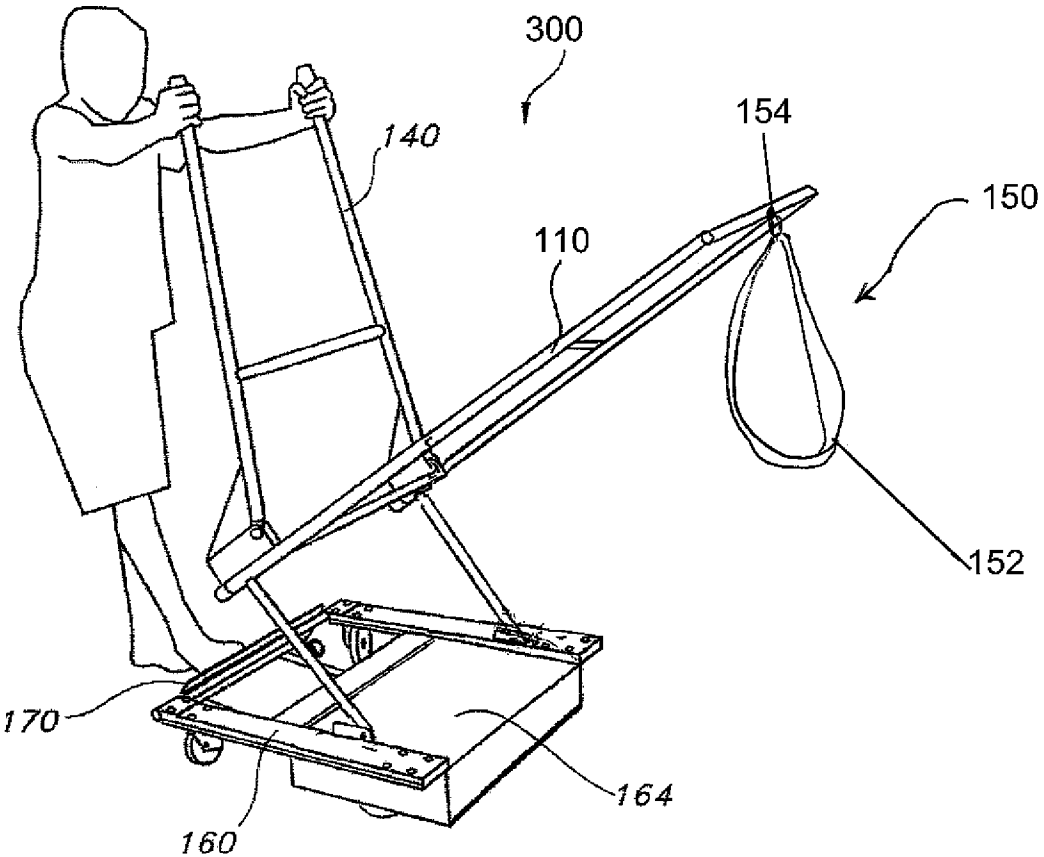
FIG. 7 illustrates a third embodiment that is particularly constructed for lifting heavy or bulky objects.

FIG. 7 illustrates a third embodiment 300 of the support device according to the invention. This support device 300 is particularly well-suited to lift heavy or bulky objects, such as, for example, large animals, heavy packages, etc. The frame 110 is extended upward in length and a lifting support means 150 pivotably suspended from a coupling means 154 provided on an upper crossbar of the frame. Crossbars and other strengthening means may be provided on the extended frame 110 as needed to achieve the desired stability and rigidity. The extended frame may also be constructed as a height-adjustable frame. This is not shown in the figures, but it will be clearly understood by those of ordinary skill in the art of constructing mechanical devices, that the upper end of the extended frame may be constructed as a telescoping frame that is selectively positionable to a desired height. The lifting support means 150 shown in FIG. 7 is a sling 152, but, depending on the intended use of the support device 300 may be any suitable container, such has a box, a cage, a platform, etc. The sling 152 is illustrated only schematically and may be adapted to the particular intended use. For example, the support device 300 may be used by veterinary services to lift large animals.

It is understood, that the lifting handles 140 on all embodiments may be constructed to be moved to a storage position. For example, the lifting handles 140 may lockable into an operating position, in which they extend rigidly out from the support frame 110 and may be movable to a storage position, in which they extend upward along the operator-side legs, so as to reduce the amount of space needed to store the support device. The lifting handles may also be constructed as telescoping handles that are lockable into an extended position and slidable to a telescoped position. These mechanical constructions are well known and are not illustrated in the drawings.

It is understood that the embodiments described herein are merely illustrative of the present invention. Variations in the construction of the patient lifting and support device may be contemplated by one skilled in the art without limiting the intended scope of the invention herein disclosed and as defined by the following claims.

What is claimed is:

1. A support device for moving a person from a first location to a second location, the support device comprising:

a support base mounted on rolling means, with a brake assembly for preventing the rolling means from rolling;

a support frame with height-adjustable legs, the support frame being pivotably mounted on the support base;

a load-lifting seat having coupling means for coupling the load-lifting seat to mating coupling means on the support frame, so as to couple the load-lifting seat about the person to be lifted;

lifting handles for pivoting the support frame about a pivot means, the lifting handles having a home position that is a lowermost position of the lifting handles; and a chest support assembly that includes a chest support that is assembled on an upper end of the height-adjustable support legs and is also pivotably attached to the support frame, the height-adjustable support legs being adjustable to raise or lower the chest support;

wherein the support frame suspendingly supports the load-lifting seat;

wherein the lifting handles are manipulable to bring the load-lifting seat to a desired position relative to the floor, a lowermost position being at floor level and an uppermost position being at a level of the load-lifting seat when the lifting handles are moved to the home position; and wherein the person supported in the load-lifting seat may be transported to a desired new location by using the lifting handles and the rolling means to guide the support device to a new location.

2. The support device of claim 1, wherein the height-adjustable legs include load-side legs and operator side legs, and wherein the lifting handles are assembled on the operator-side legs.

3. The support device of claim 2, wherein a lower end of the load-side legs is pivotably coupled to the pivot means and a lower end of the operator-side legs remains free of attachment to the support base, so as to allow the support frame to tilt toward a patient.

4. The support device of claim 1, the brake assembly comprising a brake pedal that is coupled with a brake means that applies a friction force to the rolling means.

5. The support device of claim 1, wherein a lower end of the height-adjustable support legs is equipped with rolling means, so as to allow the height-adjustable support legs to roll along the support base.

6. A support device for moving a load from a first location to a second location, the support device comprising:

a support base mounted on rolling means, with a brake assembly for preventing the rolling means from rolling, the brake assembly comprising a brake pedal that is coupled with a brake means that applies a friction force to the rolling means;

a support frame with height-adjustable legs that include load-side legs and operator side legs, the support frame being pivotably mounted on the support base;

a load-lifting seat having coupling means for coupling the load-lifting seat to mating coupling means on the support frame, so as to couple the load-lifting seat about the load to be lifted;

lifting handles for pivoting the support frame about a pivot means, the lifting handles having a home position that is a lowermost position of the lifting handles; and wherein the support frame suspendingly supports the load-lifting seat;

wherein the lifting handles are assembled on the operator-side legs and manipulable to bring the load-lifting seat to a desired position relative to the floor, a lowermost position being at floor level and an uppermost position being at a level of the load-lifting seat when the lifting handles are moved to the home position; and wherein a lower end of two or more of the height-adjustable support legs is equipped with rolling means, so as to allow the two or more height-adjustable support legs to roll along the support base; and wherein a load supported in the load-lifting seat may be transported to a desired new location by using the lifting handles and the rolling means to guide the support device to a new location.

* * * * *